United States Patent [19]

Jones

[11] Patent Number: 4,807,663

[45] Date of Patent: Feb. 28, 1989

[54] MANIFOLD FOR THE APPLICATION OF AGRICULTURAL AMMONIA

[76] Inventor: James S. Jones, 45 Crown Pl., Richardson, Tex. 75080

[21] Appl. No.: 77,193

[22] Filed: Jul. 24, 1987

[51] Int. Cl.[4] ..... B05B 1/34

[52] U.S. Cl. ..... 137/561 A; 239/553.3; 239/593; 137/550

[58] Field of Search ..... 137/561 R, 561 A, 550; 239/552, 553, 553.3, 590, 593

[56] References Cited

U.S. PATENT DOCUMENTS

| | | | |
|---|---|---|---|
| 1,717,887 | 6/1929 | Noack | 239/553.3 |
| 2,073,187 | 3/1937 | Webb | 239/552 X |
| 2,631,889 | 3/1953 | Johnson, Jr. | 839/553.3 X |
| 3,272,231 | 9/1966 | Livingston | 137/561 R |
| 3,297,260 | 1/1967 | Barlow | 137/550 |
| 3,762,649 | 10/1973 | Dalhaus | 239/552 X |
| 4,256,140 | 3/1981 | Swaroop et al. | 137/561 A |
| 4,497,664 | 2/1985 | Verry | 239/593 |

OTHER PUBLICATIONS

Continental $NH_3$ Products Co., Inc. catalog, p. FC-7, dated 1978.

John Blue Company Promotional Sheet for A-6600 Manifold, dated 1982.

*Primary Examiner*—John Rivell

*Attorney, Agent, or Firm*—Daniel V. Thompson

[57] ABSTRACT

A manifold for the application of agricultural ammonia includes an acceleraing chamber between an inlet and a plurality of discharge ports.

8 Claims, 1 Drawing Sheet

MANIFOLD FOR THE APPLICATION OF AGRICULTURAL AMMONIA

TECHNICAL FIELD

The present invention relates to manifolds, and more particularly to a manifold for use in agricultural ammonia application systems.

BACKGROUND OF THE INVENTION

The required application rates of ammonia in pounds per acre are quite varied depending on the crop, rainfall, the quality of the soil, the previous crop, the type of seed, etc. In general, the more vegetation above the soil the greater the requirement for ammonia. Applicator knife spacing is generally greater for corn, sorghum and the larger grains than it is for wheat, rice and the smaller grains. Some crops are sensitive to nitrogen rate, for example, popcorn and rice are not very tolerant of over or under application, and therefore the distribution across the tool bar from the manifold to the applicator knives is very important.

Ammonia at one atmosphere has a dew point of −28° with a latent head of 598.3 BTU and is stored as a liquid in a pressurized container under pressure due to its own vapor pressure. Any drop in pressure of the system requires a related temperature drop. The temperature drop is provided by the vaporizing of liquid within the system.

The behavior of ammonia in a system applying it to the soil is very similar to the capillary control of a refrigerating system, where resistance to flow is thermal as well as physical. In the application of ammonia, it is desirable to overcome the thermal resistance of flow physically with throttling means within the meter. The thermal resistance to flow can be expressed as the reduction of mass per unit volume. The ideal manifold would be one that presents to each of the discharges a product of equal mass per unit volume and of equal velocity. At very low rates of application, the liquid and vapor will separate with the liquid seeking the inner surfaces of the manifold receiving less outside head. The usual manifold having some plugged outlets behaves very similar to the vapor degreaser only at a much lower temperature. Should there be three or more orificed outlets grouped with plugged outlets on either side, the refrigeration due to the pressure drop across the orificed outlets will provide more mass to the center outlet and this condition will perpetuate itself due to the temperature drop across the orifices.

Conventional manifolds presently in use have a fairly large, disc shaped, central interior with an inlet at the top. Better manifolds have a screen separating the inlet from the discharges, such as manifold No. A60075, manufactured by Continental $NH_3$ Products Co. of Dallas, Tex. John Blue Co. manufactures an adjustable orificed 24 outlet manifold, its manifold No. A-6600.

SUMMARY OF THE INVENTION

A manifold for receiving metered anhydrous ammonia that is a variable combination of liquid and vapor routes the ammonia to the outlets of an applicator for proper injection into the soil by continually accelerating the ammonia as it approaches a discharge member having a plurality of discharge ports evenly spaced and retained between a body member and a bonnet member to form a restriction of equal value for each discharge port.

BRIEF DESCRIPTION OF THE DRAWINGS

A more complete understanding of the invention and its advantages will be apparent from the Detailed Description taken in conjunction with the accompaning Drawings in which.

DETAILED DESCRIPTION

Figure 1:
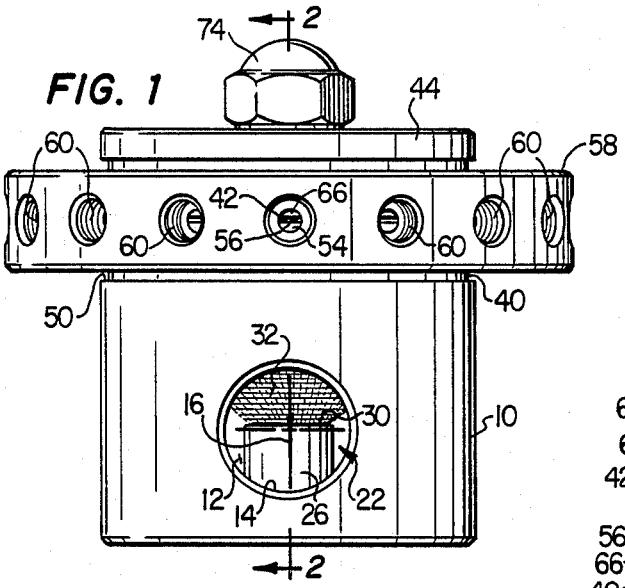
FIG. 1 is a side view of the assembled manifold.
Figure 2:
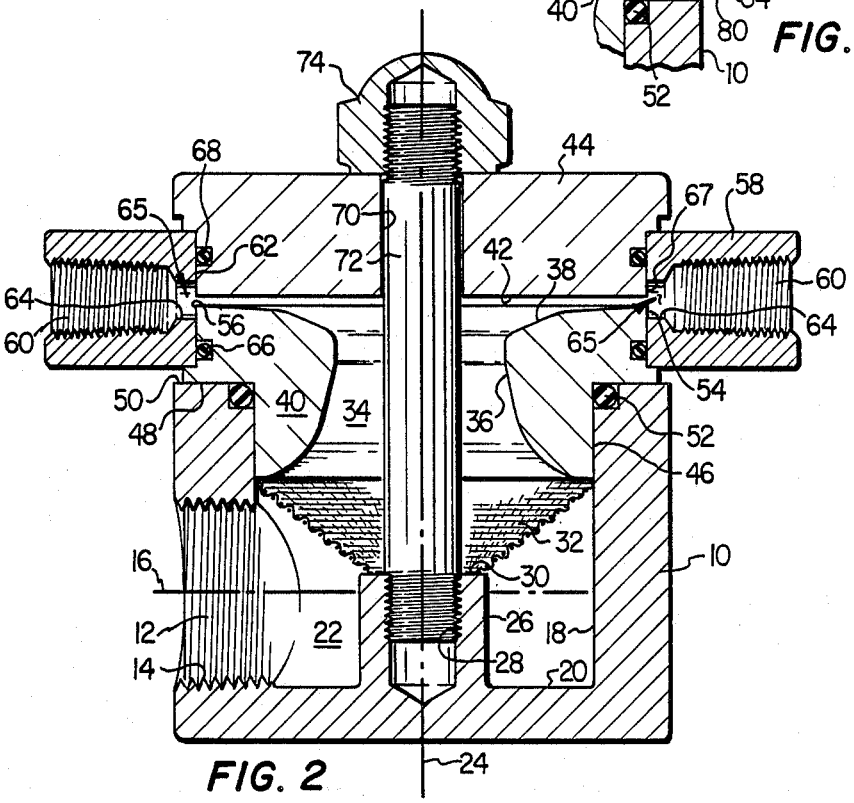
FIG. 2 is a sectional view taken along lines 2—2 of FIG. 2.

Referring initially to FIGS. 1 and 2, the manifold of the present invention includes a body member 10 having an inlet 12 defined by horizontally cylindrical wall 14 about an inlet axis 16. In the preferred embodiment, wall 14 is threaded to accept a conventional fitting. Body member 10 further includes a vertically cylindrical upper wall 18 and a horizontally planar lower wall 20 defining a receiving chamber 22 in communication with inlet 12. The receiving chamber upper wall 18 is cylindrical about a main axis 24 intersecting inlet axis 16. A raised internal threaded boss 26 extends from the receiving chamber lower wall 20, with threads 28 being circular about main axis 24. Boss 26 includes a boss upper surface 30. Screen 32 extends from boss upper surface 30 to the receiving chamber upper wall 18. Screen 32 is frustro-conical about main axis 24.

Screen 32 separates the receiving chamber 22 from an accelerating chamber 34. Accelerating chamber 34 is formed by converging lower inner wall 36, widely diverging upper inner wall 38 of accelerating member 40 and horizontally planar lower wall 42 of bonnet member 44. Accelerating member 40 includes a vertically cylindrical lower outer wall 46 engaged with the upper wall 18 of receiving chamber 22. The accelerating member 40 also includes an intermediate planar surface 48 engaged with an upper planar surface 50 of body member 10. An O-ring 52 seals the connection between body member 10 and accelerating member 40. Accelerating member 40 also includes a vertically cylindrical upper outer wall 54 sized more largely than lower outer wall 46. Inner walls 36 and 38 of the accelerating member have circular cross-sections about main axis 24. Upper inner wall 38 asymptotically approaches horizontal as it diverges and extends to an upper edge 56 of upper outer wall 54.

Annular discharge member 58 has equally spaced radial discharge ports 60 extending therethrough from the inner wall 62 thereof. Each discharge port 60 includes a horizontally cylindrical wall 64 defining a discharge orifice 65 in the discharge member inner wall 62. The connection between upper outer wall 54 of accelerating member 40 and inner wall 62 of discharge member 58 is sealed by O-ring 66.

Bonnet member 44 includes a vertically cylindrical lower outer wall 67, which is sealed to inner wall 62 of discharge member 58 by O-ring 68. Bonnet member lower outer wall 67 has the same diameter as upper outer wall 54 of accelerating member 40. Bonnet member planar lower wall 42 is spaced apart from upper edge 56 of accelerating member 40 to form a gap, and the gap is aligned with the discharge orifices 65 of the discharge member 58.

Bonnet member 44 further includes a vertically cylindrical inner wall 70 about main axis 24. Stud 72 is threaded into threads 28 of boss 26 and extends through inner wall 70 of bonnet member 22. Retaining nut 74 is threaded over the end of stud 72 to compressibly mount the bonnet member 44, discharge member 58, accelerating member 40, and screen 32 to the body member 10.

Figure 3:
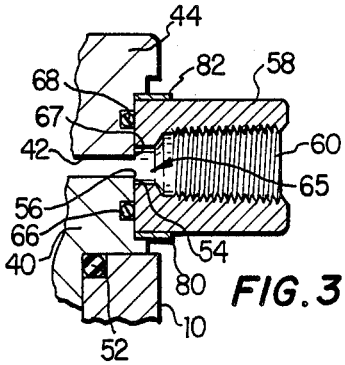
FIG. 3 is a partially broken-away side view of a discharge port showing the use of spacers to increase the spacing of the gap adjacent each discharge orifice.

Referring now to FIG. 3, the width of the gap between the lower planar surface 42 of bonnet member 44 and the upper edge 56 of accelerating member 40 is variable by the insertion of spacer washer 80 between accelerating member 40 and discharge member 58 and/or spacer washer 82 between bonnet member 44 and discharge member 58.

In operation, as metered ammonia enters the receiving chamber 22, some of its kinetic energy is destroyed through eddies and friction, etc., while the ammonia retaining its kinetic energy tends to run up the portion of wall 18 opposing the inlet 12. The screen 32 destroys additional kinetic energy and evens out the upward flow of ammonia as it is accelerated upward through the converging portion of the accelerating chamber 34 formed by lower inner wall 36. The ammonia is then further accelerated outward to the discharge ports 60 between the widely diverging upper inner wall 38 of accelerating member 40 and the planar lower wall 42 of bonnet member 44. The resistance of the system downstream from the discharge ports 60 to the soil is small as compared to the resistances of discharge orifices 65, which enhances even distribution. The acceleration of ammonia upward through the accelerating member 40 is a joint effort of all the discharge ports 60. As the ammonia turns outward it is further accelerated and the efflux of the individual discharge ports become effective, and should one discharge port 60 receive ammonia having less mass per unit volume, there would be a velocity increase and, according to Bernoulli's principle, a corresponding pressure drop moving ammonia in its direction. The ability of a discharge port 60 to receive its share of ammonia is related to its efflux volume over the total volume of the outward portion of the accelerating chamber defined by diverging wall 38 and planar wall 42.

In the application of ammonia during the late fall and early spring for corn using large tool bars with wide rows, high outputs, and high tractor speeds, the resistance of the discharge ports 60 will be too great for proper application, so spacer washers 80 and 82 are placed between the discharge member 58 and bonnet member 44 and/or discharge member 58 and accelerating member 40, as shown in FIG. 3, to increase the area of the gap opposite the discharge orifices 65.

The manifold preferably is mounted on a tool bar with retaining nut 74 easily accessible to change the spacer washers 80 and 82, clean the screen 32, or check the interior of the manifold for foreign particles.

Whereas the present invention has been described with respect to a specific embodiment thereof, it will be understood that various changes and modifications will be suggested to one skilled in the art and it is intended to encompass such changes and modifications as fall within the scope of the appended claims.

I claim:

1. A method for equalizing the distribution of flow of a liquid and vapor mixture from a single inlet to a plurality of outlets, comprising:

introducing the liquid and vapor mixture into a body having said single inlet;

receiving said vapor and liquid mixture through said inlet in a receiving chamber within said body;

expelling said vapor and liquid mixture through said plurality of outlets; and accelerating said vapor and liquid mixture in an accelerating chamber defining a liquid and vapor flow path between said receiving chamber and said outlets, said accelerating chamber having accelerating means for accelerating said liquid and vapor mixture through said flow path to said outlets.

2. The method of claim 1 wherein the accelerating means includes:

an accelerating member having circular crosssections with an inner throat of decreasing diameter in the direction of said flow path, with said liquid and vapor flow being accelerated through said throat.

3. The method of claim 1 wherein:

a screen is disposed between said receiving chamber and said accelerating chamber, said screen being permeable to the liquid and vapor mixture passing from said receiving chamber into said accelerating chamber.

4. A manifold device for directing the flow of a liquid and vapor mixture from a single inlet to a plurality of outlets comprising:

a body defining a cylindrical cavity and corresponding circular opening to the cavity;

an accelerating member engaged with said body cavity opening and having a converging first inner wall and a widely diverging second inner wall extending to an edge of an outer wall of the accelerating member;

a discharge member engaged with the outer wall of the accelerating member and having equally spaced outlets about the periphery thereof, each said outlet having walls defining a passage; and a bonnet engaged with said discharge member and having an inner wall opposite said widely diverging second inner wall of said accelerating member, said bonnet member inner wall extending to an edge spaced apart from the edge of the accelerating member outer wall to form a gap, and said outlet walls being adjacent the accelerating member edge and bonnet member edge, such that a flow path is defined through said gap into each outlet passage.

5. The manifold device of claim 4 further comprising:

at least one fastener coupled to said body, the opposite end of said fastener extending to a location outside of said bonnet.

6. A manifold device for directing the flow of a liquid and vapor mixture from a single inlet to a plurality of outlets comprising:

a body defining a cylindrical cavity and corresponding circular opening to the cavity;

an accelerating member engaged with said body cavity opening and having a converging first inner wall and a widely diverging second inner wall extending to an edge of an outer wall of the accelerating member;

a discharge member engaged with the outer wall of the accelerating member and having equally spaced outlets about the periphery thereof, each said outlet having walls defining a passage;

a bonnet engaged with said discharge member and having an inner wall opposite said widely diverging second inner wall of said accelerating member, said bonnet member inner wall extending to an edge spaced apart from the edge of the accelerating member outer wall to form a gap, and said outlet walls being adjacent the accelerating member edge and bonnet member edge, such that a flow path is defined through said gap into each outlet passage; and at least one spacer washer removably interposed adjacent said discharge member to vary said gap of said flow path.

7. A manifold device for directing the flow of a liquid and vapor mixture from a single inlet to a plurality of outlets comprising:

a body defining a cylindrical cavity and corresponding circular opening to the cavity;

an accelerating member engaged with said body cavity opening and having a converging first inner wall and a widely diverging second inner wall extending to an edge of an outer wall of the accelerating member;

a discharge member engaged with the outer wall of the accelerating member and having equally space outlets about the periphery thereof, each said outlet having walls defining a passage;

a bonnet engaged with said discharge member and having an inner wall opposite said widely diverging second inner wall of said accelerating member, said bonnet member inner wall extending to an edge spaced apart from the edge of the accelerating member outer wall to form a gap, and said outlet walls being adjacent the accelerating member edge and bonnet member edge, such that a flow path is defined through said gap into each outlet passage; and said gap being adjustable by adding or removing spacer washers of various thickness adjacent the discharge member, whereby adding said spacer washers will increase the gap between said bonnet edge and said accelerating member edge, thereby enlarging the flow path to each said outlet passage.

8. A manifold, comprising:

a body member;

the body member having a horizontally cylindrical wall defining an inlet about an inlet axis;

the body member further having a vertically cylindrical upper wall and a horizonally planar lower wall defining a receiving chamber in communication with the inlet, the receiving chamber upper wall being cylindrical about a main axis intersecting the inlet axis;

a boss extending from the receiving chamber lower wall to a boss upper surface and having interior threads about the main axis;

a screen extending from the boss upper surface to the receiving chamber upper wall and being frustroconical about the main axis;

an accelerating member having a vertically cylindrical lower outer wall engaged with the upper wall of the receiving chamber;

the accelerating member further having a vertically cylindrical upper outer wall being sized more largely than the lower outer wall thereof, the upper outer wall being cylindrical about the main axis and having an upper edge;

the accelerating member further having an interior wall with a converging lower portion and a widely diverging upper portion, the lower and upper portions having circular cross-sections about the main axis, and the widely diverging upper portion asymptotically approaching horizontal and extending to the upper edge of the accelerating member upper outer wall;

an annular discharge member having a vertically cylindrical inner wall engaged with the upper outer wall of the accelerating member and having a plurality of radial discharge ports extending through the discharge member from its inner wall, each discharge port including a horizontally cylindrical wall defining a discharge orifice in the discharge member inner wall;

a bonnet member having a vertically cylindrical lower outer wall engaged with the discharge member inner wall and having a horizontally planar lower wall, the bonnet member lower outer wall having the same diameter as the accelerating member upper outer wall, the bonnet member planar lower wall being spaced apart from the upper edge of the accelerating member upper outer wall to form a gap, and the gap being aligned with the discharge orifices of the discharge member;

the bonnet member further comprising an inner wall being vertically cylindrical about the main axis; and fastening means extending through the bonnet member inner wall to the boss for compressibly mounting the bonnet member, discharge member, accelerating member and screen to the body member.

* * * * *